United States Patent [19]

Zeitler

[11] Patent Number: 4,852,449

[45] Date of Patent: Aug. 1, 1989

[54] NECK ROD MEMBER FOR STRINGED INSTRUMENTS

[75] Inventor: Walter Zeitler, Röslau, Fed. Rep. of Germany

[73] Assignee: Hans-Peter Wilfer

[21] Appl. No.: 138,335

[22] Filed: Dec. 28, 1987

[30] Foreign Application Priority Data

Dec. 30, 1986 [DE] Fed. Rep. of Germany ..... 3644694

[51] Int. Cl.[4] ..... G10D 1/08

[52] U.S. Cl. ..... 84/293

[58] Field of Search ..... 84/293

[56] References Cited

U.S. PATENT DOCUMENTS

| | | | |
|---|---|---|---|
| 2,460,943 | 2/1949 | Nelson | 84/293 |
| 3,416,399 | 12/1968 | Baldoni | 84/293 |
| 4,308,780 | 1/1982 | Boucher | 84/293 |
| 4,508,003 | 4/1985 | Smakula | 84/293 |
| 4,557,174 | 12/1985 | Gresset, Jr. | 84/293 |

FOREIGN PATENT DOCUMENTS 7824673 1/1973 Fed. Rep. of Germany .

*Primary Examiner*—Lawrence R. Franklin

*Attorney, Agent, or Firm*—Toren, McGeady & Associates

[57] ABSTRACT

A neck rod member for stringed instruments, particularly for bass guitars. The rod member includes two oblong rod portions which extend parallel relative to each other and essentially contact one another. At one end of the rod member, the portions are fixedly connected to each other, for example, by rivets. At the other free ends of the rod portions, a mechanism for effectively shortening the length of one of the rod portions relative to the effective length of the other rod portion is provided. The neck of the instrument defines an oblong blind-end hole which is open at the free end of the neck. The rod member can be inserted into the blind-end hole in such a way that the mechanism for shortening the effective length of the first rod portion is accessible from the open end of the blind-end bore. The neck rod member includes another mechanism for shortening the effective length of the second rod portion relative to the effective length of the first rod portion. This second mechanism is also accessible from the open end of the blind-end hole.

11 Claims, 3 Drawing Sheets

Fig.1
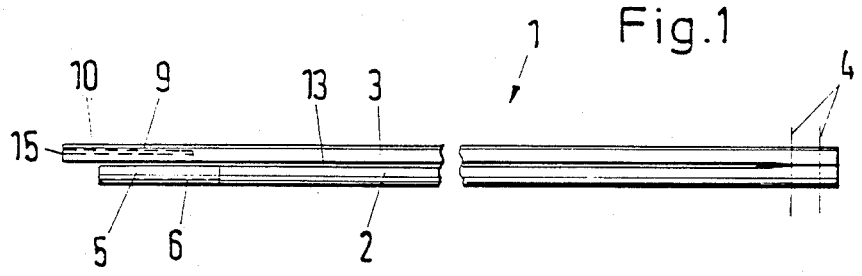
Fig.2
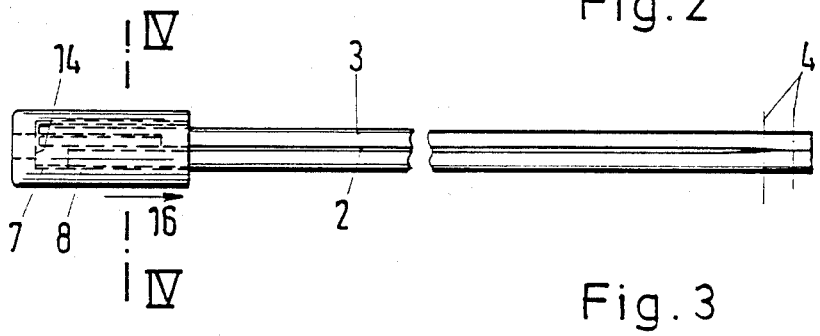
Fig.3
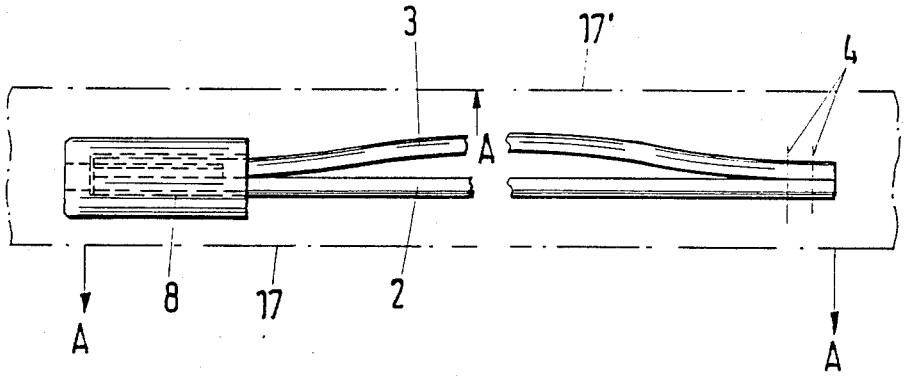
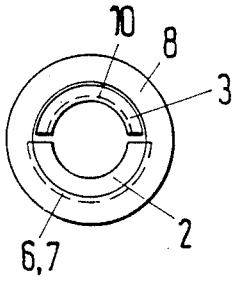
Fig.4

NECK ROD MEMBER FOR STRINGED INSTRUMENTS

BACKGROUND OF THE INVENTION

1. Field of the Invention

The present invention relates to a neck rod member for stringed instruments, particularly for bass guitars. The rod member includes two oblong rod portions which extend parallel relative to each other and essentially contact one another. At one end of the rod member, the rod portions are fixedly connected to each other, for example, by riveting. At the other free ends of the rod portions, a means for effectively shortening the length of one of the rod portions relative to the effective length of the other rod portion is provided. The neck of the instrument defines an oblong blind-end hole which is open at the free end of the neck. The rod member can be inserted into the blind-end hole in such a way that the means for shortening the effective length of the first rod portion is accessible from the open end of the blind-end hole.

2. Description of the Prior Art

A neck rod member of the above-described type is known from U.S. Pat. No. 4,308,780 and German Utility Model No. 78 24 673. Such a neck rod member is inserted into the oblong blind-end hole in the neck of the instrument. The rod member is secured in this hole once one of the rod portions is braced within the hole, as described in detail below. Consequently, a separate means for fastening the rod member in the hole of the neck of the instrument is not necessary. The effective length of one of the rod portions is shortened relative to the other rod portion by rotating a cap nut. As a result, the rod member which previously was straight becomes curved into an arc and, thus, the neck of the instrument also assumes the shape of an arc, wherein the convex side of the arc faces the strings resting on the fingerboard of the neck. The above-described bracing action counteracts the relatively strong tension exerted on the neck of the instrument by the strings. Without the bracing action, the danger exists that the tension of the strings will bend or even break the neck of the instrument.

However, in some stringed instruments, particularly in special types of bass guitars, it may be required, for example, due to the grain of the wood of the neck or for other reasons, that the neck rod member should exert a force on the neck of the instrument which is directed in the same direction as the tension force of the strings. The neck rod member of the type described above is not suitable for this purpose.

U.S. Pat. No. 4,557,174 describes a neck rod member which consists of a single piece. This rod member is inserted into the neck of the instrument and is approximately in the middle thereof fixedly connected to the neck of the instrument by an anchoring means. The rod member must be bent into the desired direction before being inserted. Because of this and particularly due to the fixed anchoring of the rod member in the neck of the instrument, an instrument equipped with the neck rod member according to U.S. Pat. No. 4,557,174 is complicated and expensive to manufacture. In addition, this neck rod member cannot be replaced once it becomes useless or damaged. Accordingly, the neck rod member according to U.S. Pat. No. 4,557,174 is of a considerably different type from the one described initially hereinabove.

It is, therefore, the primary object of the present invention to provide a rod member of the type initially described which can be deformed optionally into a convex or concave arc shape relative to the neck of the instrument. However, the advantages of loosely inserting the rod member into the blind-end hole of the instrument neck and the loose removal therefrom are to be maintained.

SUMMARY OF THE INVENTION

In accordance with the present invention, another means for shortening the effective length of the second rod portion relative to the effective length of the first rod portion is provided. This second means is also accessible from the open end of the blind-end hole.

The neck rod member according to the present invention can be used for both types of applications described above, i.e., the bracing of the rod member into a convex arc, as well as for providing the neck member inserted into the neck with an arc whose concave side faces the fingerboard or the strings of the instrument. Thus, a single neck rod member can be used for both situations. This not only reduces the manufacturing costs, but substantially reduces the quantities which have to be kept in stock at the manufacturer and the instrument builder. Finally, the user of the instrument can use the kind of adjustment or arc of the neck rod member which he considers suitable.

The neck rod member of the type described above is insertable into the blind-end hole of the instrument neck. The neck rod member can be securely braced within the blind-end hole of the neck by bending the rod member in the desired direction, so that the rod member cannot inadvertently slide out of the blind-end hole. Both rod portions can be adjusted in the desired manner by reaching into the open end of the blind-end hole. The rod portions preferably do not project out of the open end of the blind-end hole, so that the rod members are not visible from the outside. The rod member can be easily pulled out of the blind-end hole.

In accordance with another feature of the present invention, the additional means for shortening the effective length of the second rod portion includes a screw or nut which is accessible from the open end of the blind-end hole. Thus, both rod portions can be adjusted easily from the open end of the blind-end hole.

In accordance with a third embodiment of the invention which starts from the above-mentioned German Utility Model No. 78 24 673, the first rod portion is provided with an external thread and is shorter than the second rod portion. In addition, a cap nut meshing with the external thread is provided. The cap nut forms a stop for the end face of the free end of the second rod portion which is longer than the first rod portion. The free end of the second rod portion has an internal thread. A set screw whose thread meshes with the internal thread of the second rod portion provides a stop, preferably in the form of a screw head for contacting the end of the first rod portion or the cap screw screwed onto the first rod portion.

Accordingly, the external thread on the shorter rod portion and the corresponding cap screw which are known from the prior art can still be used, while merely the internal thread on the second longer rod portion and the set screw must be provided. Thus, starting from the known rod members, a conversion to manufacturing the rod member according to the present invention is relatively inexpensive. In addition, a readjustment in the use of the rod member is not required. Rather, it is only necessary to learn to use the additional adjusting means in the form of the above-described set screw.

The rod member according to the present invention has the additional advantage that the thickness of the end portion of the rod member is the same as the thickness of the prior art rod members. Only the length of the rod member is slightly increased by the thickness of the set screw head, however, this has virtually no practical consequences.

In order to prevent an unintentional turning of the cap screw when the set screw is adjusted, it is possible to provide the internal thread at the end of the second rod portion as a left-handed thread and the external thread of the first rod portion as a right-handed thread, or vice-versa, or to provide the internal thread of the end of the second rod portion with a pitch which differs from the pitch of the external thread of the first rod portion.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

FIG. 1 is a schematic side view of a neck rod member according to the present invention without cap nut;

FIG. 2 is a schematic side view of the neck rod member of FIG. 1 including a cap nut, the rod member being shown in the unbraced state;

FIG. 3 is a schematic side view of neck rod member of FIG. 1 including cap nut, wherein the rod member is braced in a convex shape, FIG. 3 further showing the outline of an instrument neck;

FIG. 4 is a cross-sectional view taken along sectional line IV—IV of FIG. 2;

DETAILED DESCRIPTION OF THE INVENTION

Figure 5:
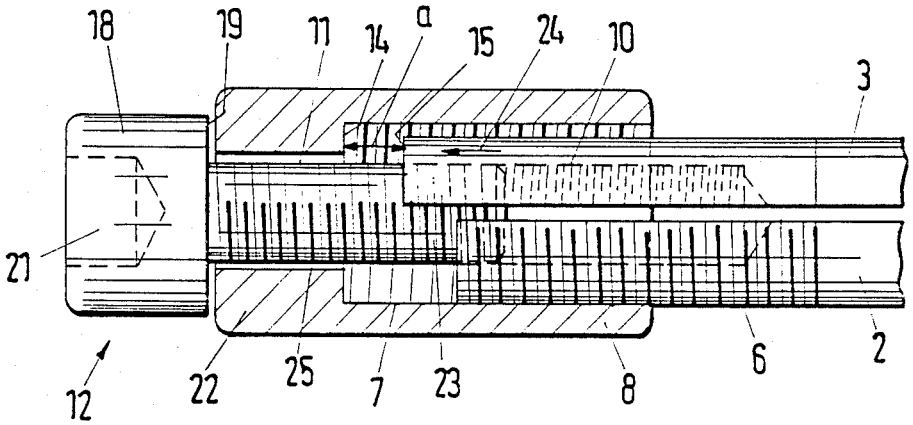
FIG. 5 is a side view, partly in section, of the left end of the unbraced neck rod member illustrated in FIG. 2.

As illustrated in the drawing, a rod neck member generally denoted by reference numeral 1 is composed of two rod portions, i.e., a first short rod portion 2 and a second longer rod portion 3. At their ends on the right-hand side as seen in FIGS. 1–3 of the drawing, the rod portions are fixedly connected with each other, for example, by means of rivets schematically illustrated by dash-dotted lines.

On the free end of the neck rod member 1 as illustrated in FIGS. 1–3, an end 5 of the shorter rod portion 2 has an external thread 6 which is capable of meshing with an internal thread 7 of a cap nut 8. End 9 of the longer rod portion 3 has an internal thread 10 which is capable of meshing with an external thread 11 of a set screw 12 which shall be described in more detail with the aid of FIGS. 5 and 6.

The threads 6 and 7 are preferably directed in the opposite direction from threads 10 and 11. Threads 6 and 7 are preferably right-handed threads and the threads 10 and 11 are left-handed threads. Thus, it is ensured that the cap nut is not inadvertently turned when the set screw is actuated. On the other hand, the pitch of threads 10 and 11 may also differ from the pitch of threads 6 and 7. Thus, when the pitch of threads 10 and 11 is greater or smaller than the pitch of threads 6 and 7, an unintentional turning of the cap nut is prevented. Different pitches can also be used if the transmission of the bracing force from the adjusting means to the rod portions is to be changed.

As illustrated in FIGS. 1 and 2 of the drawing, rod portions 2 and 3 are placed closely next to each other and are separated from each other only by a thin gap 13. After the cap nut 8 has been screwed onto the free end of rod member 1, the inner surface 14 of cap nut 8 comes into contact with the end face 15 of rod portion 3. When cap nut 8 is turned further, it moves in the direction of arrow 16 shown in FIG. 2 and the shorter rod portion 2 is pulled against the direction of arrow 16 into the cap nut 8. This effective shortening of the length of the rod portion 2 results in a corresponding lengthening of the relative length of the rod portion 3, so that rod portion 3 is bent upwardly into an arc shape, as illustrated in FIG. 3. The convex side of this arc is directed toward the fingerboard 26 and, thus, toward the strings 27 of the neck 17 of instrument 31, the neck 17 being shown in FIG. 3 only in dash-dotted lines. Further details of the structure of the rod member and the instrument neck can be found in FIG. 7. Strings 27 and fingerboard 26 are located on the side of the neck denoted by reference numeral 17'. For clarity's sake, the arc of the rod portion 3 is shown exaggerated in FIG. 3 of the drawing.

Figure 6:
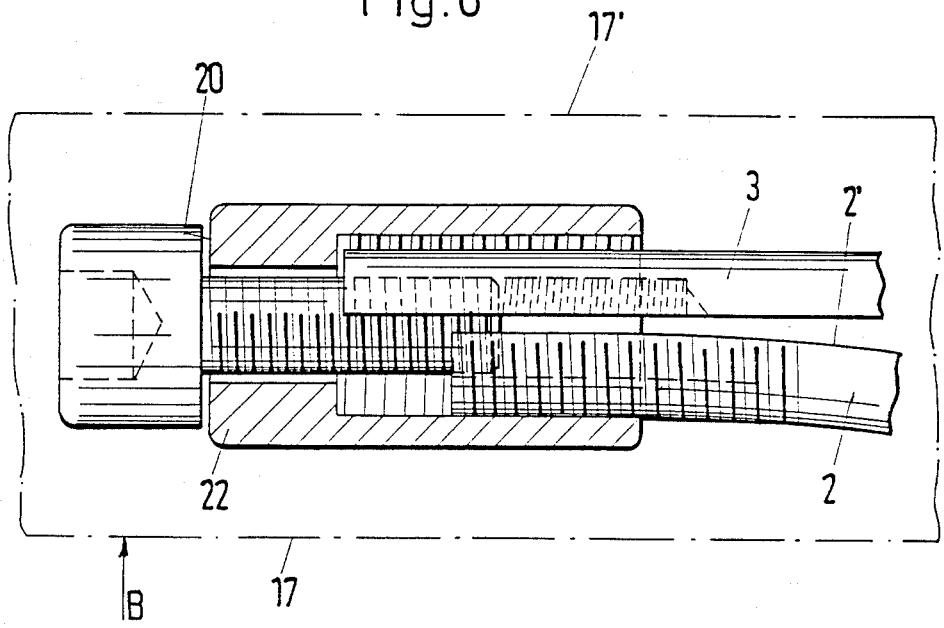
FIG. 6 is a side view corresponding to FIG. 5, wherein the neck rod member is concavely braced, the outline of the instrument neck being shown in dash-dotted lines.

The above-described internal thread 10 in connection with the set screw 12 serves as the additional adjusting means for shortening the effective length of the second rod portion 3 relative to the effective length of the first rod portion 2. The external thread 11 of set screw 12 meshes with internal thread 10. Set screw 12 has a head 18 which forms an end face 19 on the right-hand side of head 18 as seen in FIGS. 5 and 6. End face 19 forms a stop which comes into contact with the end face 20 of cap nut 8.

In the initial position of the adjustment procedure according to FIG. 5, the surface's 19 and 20 are in contact with each other and the cap nut is screwed onto thread 6 to such an extent that cap nut 8 surrounds both rod portions 2 and 3, while a distance a remains between the end face 15 of rod portion 3 and the inner end face 14 of bottom 22 of cap nut 8. In accordance with a preferred embodiment, the distance a may be, for example, 4 mm.

When set screw 12 is turned such that the rod portion 3 is moved toward the left along shaft 23 of set screw 12 in the direction of arrow 24 shown in FIG. 5 whereby the distance a becomes smaller, this results in an effective shortening of the upper rod portion 3 and, thus, an effective relative lengthening of the lower rod portion 2. Set screw 12 can be turned until distance a becomes practically zero as shown in FIG. 6. As illustrated in FIG. 6, the rod portion 2 is now bent into a downwardly directed arc whose concave side 2' faces the neck side 17' which includes fingerboard 26 and strings 27.

Accordingly, in the arrangement illustrated in FIGS. 1–3 which includes cap nut but not a set screw, a convex arching of the rod member results in forces acting on neck 17 in the direction of arrows A. In the arrangement which includes the use of set screw 12 as shown in FIGS. 5 and 6, forces are acting on neck 176 which are directed in the opposite direction to arrow A. In FIG. 6, these forces are illustrated by the arrow B on the left-hand side.

Figure 7:
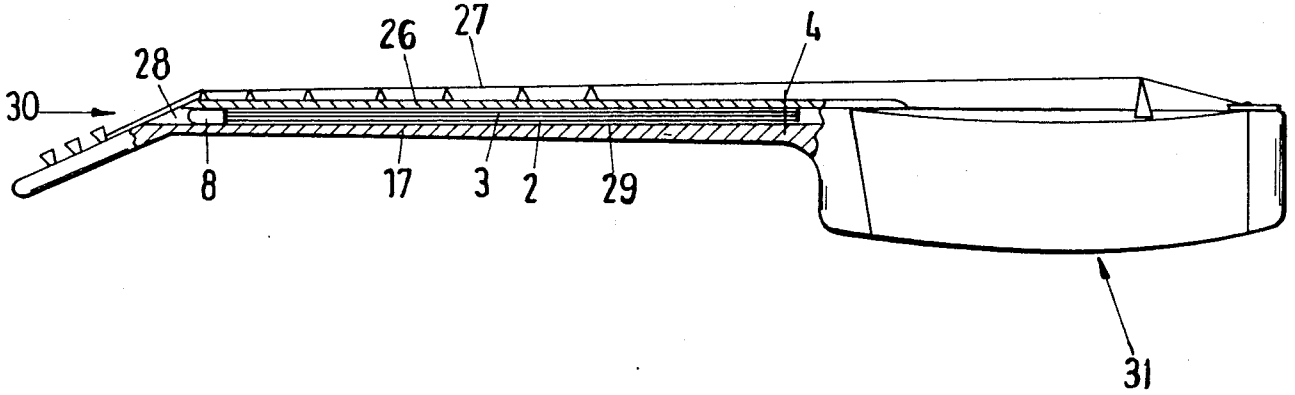
FIG. 7 is a side view, partly in section, of a stringed instrument with the rod neck member according to the present invention incorporated in the neck of the instrument.

Head 18 of set screw 12 may have a hexagonal recess 21 for inserting a wrench. Such a hexagonal recess can also be provided at the bore 25 of cap nut 8. Thus, set screw 12 and cap nut 8 can be adjusted independently from the free end 28 of blind-end hole 29 by inserting appropriate wrenches in the direction of arrow 30, as shown in FIG. 7.

While a specific embodiment of the invention has been shown and described in detail to illustrate the application of the inventive principles, it will be understood that the invention may be embodied otherwise without departing from such principles.

I claim:

1. In a neck rod member for stringed instruments having a neck with a free end, the neck defining a blind-end bore open at the free and of the neck, the neck rod member including first and second oblong rod portions which extend parallel relative to each other and essentially contact one another, the first and second rod portions each having first and second ends, the first ends of the first and second rod portions being fixedly connected to each other, the second ends of the first and second rod portions at the free end of the neck including first means for effectively shortening the length of the first rod portion relative to the effective length of the second rod portion, the neck rod member being inserted into the blind-end bore such that the means for shortening the effective length of the first rod portion is accessible from the opening of the blind-end bore at the free end of the neck, the improvement comprising second means for shortening the effective length of the second rod portion relative to the effective length of the first rod portion, the second means also being accessible from the opening of the blind-end bore at the free end of the neck, wherein the first rod portion is shorter than the second rod portion, the first rod portion having an external thread at the second end thereof, a cap nut being mounted on the external thread, the second end of the second rod defining an end face, the cap nut forming a stop means for the end face of the second rod portion, the second end of the second rod portion having an internal thread, a set screw having an external thread being mounted in the internal thread, the set screw defining a stop means for contacting the cap nut.

2. The neck rod member according to claim 1, wherein the stringed instrument is a bass guitar.

3. The neck rod member according to claim 1, wherein the first ends of the rod portions are riveted to each other.

4. The neck rod member according to claim 1, wherein the cap screw includes a bottom, the bottom defining a polygonal recess for the insertion of a wrench.

5. The neck rod member according to claim 4, wherein the recess is hexagonal.

6. The neck rod member according to claim 1, wherein the set screw includes a screw head, the screw head defining the stop means of the set screw.

7. The neck rod member according to claim 1, wherein the internal thread at the second end of the second rod portion is a left-handed thread and the external thread of the second end of the first rod portion is a right-handed thread, or vice-versa.

8. The neck rod member according to claim 1, wherein the internal thread of the second end of the second rod portion has a pitch which differs from the pitch of the external thread of the second end of the first rod portion.

9. The neck rod member according to claim 1, wherein the second ends of the rod portions each have the cross-sectional shape of an annular cylinder half, the annular cylinder defining the external thread of the first rod portion and the internal thread of the second rod portion.

10. The neck rod member according to claim 1, wherein the head of the set screw defines a polygonal recess for the insertion of a wrench.

11. The neck rod member according to claim 10, wherein the recess is hexagonal.

* * * * *

UNITED STATES PATENT AND TRADEMARK OFFICE

CERTIFICATE OF CORRECTION

PATENT NO. : 4,852,449

DATED : August 1, 1989

INVENTOR(S) : Walter Zeitler

It is certified that error appears in the above-identified patent and that said Letters Patent is hereby corrected as shown below:

On the title page, item [21] Appl. No.:
"138,335" should read --138,355--.

Signed and Sealed this

Twelfth Day of June, 1990

*Attest:*

HARRY F. MANBECK, JR.

*Attesting Officer*

*Commissioner of Patents and Trademarks*